US009879454B2

(12) United States Patent
Bendel et al.

(10) Patent No.: US 9,879,454 B2
(45) Date of Patent: Jan. 30, 2018

(54) MOTOR VEHICLE DOOR

(71) Applicant: Kiekert Aktiengesellschaft, Heiligenhaus (DE)

(72) Inventors: Thorsten Bendel, Oberhausen (DE); Michael Merget, Mettmann (DE)

(73) Assignee: Kiekert Aktiengesellschaft, Heiligenhaus (DE)

( * ) Notice: Subject to any disclaimer, the term of this patent is extended or adjusted under 35 U.S.C. 154(b) by 100 days.

(21) Appl. No.: 14/655,080

(22) PCT Filed: Dec. 13, 2013

(86) PCT No.: PCT/DE2013/000778
§ 371 (c)(1),
(2) Date: Sep. 11, 2015

(87) PCT Pub. No.: WO2014/090221
PCT Pub. Date: Jun. 19, 2014

(65) Prior Publication Data

US 2016/0032624 A1 Feb. 4, 2016

(30) Foreign Application Priority Data

Dec. 13, 2012 (DE) ..... 10 2012 024 376

(51) Int. Cl.
*E05C 17/00* (2006.01)
*E05D 11/08* (2006.01)
(Continued)

(52) U.S. Cl.
CPC ..... *E05C 17/003* (2013.01); *E05B 81/08* (2013.01); *E05B 81/64* (2013.01); *E05D 11/08* (2013.01);
(Continued)

(58) Field of Classification Search
CPC ..... E05Y 2900/531; E05Y 2201/21; E05Y 2201/25; E05Y 2201/254; E05Y 2201/256; E05Y 2400/21
See application file for complete search history.

(56) References Cited

U.S. PATENT DOCUMENTS 3,046,893 A * 7/1962 Carlson, Jr. ..... H02K 44/04 310/11
5,468,042 A * 11/1995 Heinrichs ..... E05C 17/305 16/51
(Continued)

FOREIGN PATENT DOCUMENTS

DE 102006037992 A1 2/2008
DE 102007026796 A1 8/2008
(Continued)

OTHER PUBLICATIONS

Machine Translation of DE102007026796A1 by Google Translation dated Sep. 10, 2015.
(Continued)

*Primary Examiner* — Justin B Rephann
(74) *Attorney, Agent, or Firm* — Woodard, Emhardt, Moriarty, McNett & Henry LLP

(57) ABSTRACT

The invention relates to a motor vehicle door comprising a door leaf with a drive, a magnetic device as a component of the drive, and at least one sensor which is associated with the door leaf. According to the invention, said magnetic device also comprises a magnetorheological element and/or a magnetohydrodynamic element which can be actuated by at least one magnet.

19 Claims, 3 Drawing Sheets

(51) Int. Cl.

| | |
|---|---|
| ***E05B 81/08*** | (2014.01) |
| ***E05B 81/64*** | (2014.01) |
| *E05F 5/00* | (2017.01) |
| *E05B 47/00* | (2006.01) |

(52) U.S. Cl.

CPC ..... *E05B 2047/0033* (2013.01); *E05F 5/00* (2013.01); *E05Y 2201/21* (2013.01); *E05Y 2201/25* (2013.01); *E05Y 2201/256* (2013.01); *E05Y 2201/266* (2013.01); *E05Y 2900/531* (2013.01)

(56) References Cited

U.S. PATENT DOCUMENTS 6,241,480 B1 * 6/2001 Chu ..... F04B 7/00 417/410.1
6,314,612 B1 * 11/2001 Rennecke ..... E05D 11/1028 16/51
7,891,474 B2 * 2/2011 McDaniel ..... F16D 37/02 188/267.2
8,225,458 B1 * 7/2012 Hoffberg ..... E05F 3/102 16/49
8,282,153 B2 * 10/2012 Browne ..... B32B 7/045 296/146.9
9,004,551 B2 * 4/2015 Browne ..... E05C 19/16 188/267.2
2006/0033312 A1 * 2/2006 Barvosa-Carter ..... B60R 21/04 280/728.1
2006/0156630 A1 7/2006 Yokomori et al.
2008/0203760 A1 * 8/2008 Cafeo ..... E05D 9/00 296/146.9
2008/0294314 A1 * 11/2008 Morris ..... E05F 5/00 701/49
2008/0309118 A1 * 12/2008 Kohlstrand ..... E05D 11/1007 296/146.1
2010/0019514 A1 * 1/2010 Steinwender ..... E05C 17/025 292/251.5
2012/0272480 A1 * 11/2012 Ac ..... E05D 11/082 16/320
2014/0042756 A1 * 2/2014 Browne ..... E05C 19/16 292/251.5

FOREIGN PATENT DOCUMENTS

DE 202008015420 U1 2/2009
DE 202008011513 U1 2/2010
EP 1249637 B1 10/2005

OTHER PUBLICATIONS

Machine Translation of DE202008011513U1 by Google Translation dated Sep. 10, 2015.
Machine Translation of DE202008015420U1 by Google Translation dated Sep. 10, 2015.
Machine Translation of EP1249637B1 by Google Translation dated Sep. 10, 2015.

* cited by examiner

MOTOR VEHICLE DOOR

CROSS-REFERENCE TO RELATED APPLICATIONS

This application is the U.S. national stage application of International Patent Application No. PCT/DE2013/000778, filed Dec. 13, 2013, which claims priority of German Application No. 10 2012 024 376.6 filed Dec. 13, 2012, which are both hereby incorporated by reference.

BACKGROUND

The invention relates to a motor vehicle door, comprising a door leaf with a drive and a magnetic device as a component of the drive and at least one sensor which is associated with the door leaf.

A motor vehicle door of the above design is, for instance, disclosed in DE 10 2007 026 796 A1, containing a device for securing open doors, tailgates or similar of a motor vehicle. The arrangement provides a stopping and retaining device containing friction surfaces moving in relation to each other. The friction surfaces contain friction bodies made of magnetisable material. Using a closed magnetic flux, the friction surfaces can be held in an applied force position by a friction body. The magnetisable flux is produced by an energisable coil, generating a magnetic field. In addition, a sensor is provided for detecting the opening position of the associated door.

In the known teaching, the material of the friction body has a reversible ferromagnetic property. As a result, the magnetic flux still remains once the magnetic field generated by the coil is switched off but can be cancelled out by applying a magnetic counter field. Such friction bodies with reversible ferromagnetic properties are generally expensive and problematic as regards reliable functioning. Motor vehicles and their associated motor vehicle doors are used in all climatic zones of the world and must thus be able to cope with temperature ranges of between −40° C. to 70° C. without any problem. Due to the Curie effect, it is doubtful whether friction bodies with reversible ferromagnetic properties and using reversibility will be able to cope with such a temperature range. The Curie temperature for ferrites is actually around 100° C. or higher, depending on the material composition, so that a temperature-related impairment of the generated magnetic field can be expected.

A drive for a door leaf as disclosed in US 2006/0156630 A1 contains a planetary gear equipped with an electromagnetic brake. This electromagnetic brake can be used to stop the drive movement of the door leaf where required.

The prior art also contains a door stay as disclosed in utility patent DE 20 2008 011 513 U1. In this door stay, the flow of force applied in the locking operation passes over a release mechanism, containing a separable connection and, in particular, a magnetic connection. This magnetic connection is, amongst other things, based on the magnetic attraction between a permanent magnet arrangement and a seat assigned to the permanent magnet arrangement.

The also relevant EP 1 249 637 B1 discloses a device for damping or suppressing vibrations in a moved system, in particular, in a vehicle drive aggregate. For this purpose, a chamber filled with a magnetorheological fluid is provided, in which a magnetic field can be generated. At least a part of the chamber contains several electric conductors, in which a current flow can be generated.

The known state of the art is not satisfactory in all aspects. The achievable damping and drives cannot be adapted to all potential functional states without problem. In practical application the problem often arises that the movement of a door leaf should be or is desired to be dampened depending on the situation. Prior art embodiments have so far not provided any convincing solutions for this.

SUMMARY

The invention is based on the technical problem of further developing such a motor vehicle door in such a way that its damping and, where applicable, the drive can be changed depending on the situation and can be adapted to the actual circumstances.

In order to solve this technical problem, a generic motor vehicle door of the invention is characterized in that the magnetic device contains a magnetorheological and/or magnetohydrodynamic element, acting upon at least one magnet. A magnetorheological element is a fluid element such as, for instance, a magnetorheological fluid or also a magnetorheological solid body, such as a magnetorheological elastomer. In all of the described cases, the function of the magnetorheological element is based on the magnetorheological effect. This magnetorheological effect can be explained by the magnetisable particles being aligned along a magnetic field that can be switched on and off and can, where applicable, be variable in strength. This can change the viscosity of a suspension containing, for instance, the magnetisable particles. As a suspension, oil, ethylene glycol or also water can be used. The magnetisable particles typically have a diameter of 1 to 10 μm and predominantly contain iron.

Instead of such magnetorheological fluids also magnetorheological elastomers can be used. These are generally made up from an elastomer matrix and magnetisable particles dispersed therein. The visco-elastic or dynamic-mechanic properties of the respective elastomers can be quickly and reversibly changed by applying an external magnetic field.

The magnetorheological element is in any case generally used as a damping element of an adjustable damping. This means that with this damping adjustable by this damping element or the magnetorheological element of the invention, the damping of the door leaf can be quickly changed, as required, with the aid of the magnetic device of the invention. It is thus feasible that the magnet, depending on the functional states of the door leaf to be monitored by the sensor, varies the damping of the damping element. In this arrangement, the sensor and the at least one magnet is typically connected to one control unit. Depending on signals from the sensor or sensor signals the control unit acts on the sensor accordingly.

The aforementioned functional states of the door leaf can, for instance, refer to its speed, acceleration, respective end stops, external temperature, etc. The sensor provides, in any case, reliable information about the current functional state or also movement state of the door leaf. A high speed during closing of the door leaf can, for instance, indicate that an operator or user exerts excessive force on the respective door leaf. In order to ensure that in this situation the rubber door seal is not excessively stressed or other potential damage results or can result and also so that the generated noise is reduced, the invention ensures that a respective speed during closing of the door leaf corresponds to the control unit acting on the magnetorheological element by means of the magnet in such a way that the door leaf is subjected to considerable damping. The result is a soft closure of the door leaf without this having been actively wanted or intended by the user. A similar process applies where the door leaf threatens, for instance, to close at high speed when the associated motor vehicle is, for instance parked on a sloping section. In this case, too, the control unit interprets respective signals of the sensor about the speed of the door leaf in such a way that the door leaf speed has to be reduced by increased damping.

In this context it is also feasible that the damping force applied to the door leaf is varied along the closing path of the door leaf, i.e. starting with a high damping force which is then reduced in order to ensure closure of the door leaf in any circumstance.

In this context it has proven to be particularly advantageous for the magnetic device with the magnetorheological or magnetohydrodynamic element acting on a magnet, being in each case directly assigned to the door leaf. Advantageously, the magnetic device is arranged in the area of a hinged axis or also directly inside a hinge with the aid of which the door leaf is flexibly connected to a respective motor vehicle body. Naturally, also other positions are feasible, for instance in the area of the door latch or inside or close to a cotter pin. The magnetic device is, however, generally integrated in the hinge axis or is mechanically connected to the hinge axis, in order to be able to directly exert the described and required damping forces on the door leaf, where required.

Alternatively or in addition to the described magnetorheological element, also a magnetohydrodynamic element can be used as a component of the magnetic device. Such a magnetohydrodynamic element is characterized by an applied magnetic field generating, for instance, a flux of a fluid. No mechanical elements are required for such a fluid flux so that the resulting drive practically operates without any noise. The respective fluid is in essence moved by the generated electromagnetic forces. As part of this process, either a reaction force can be directly used for a drive or, for instance, also the fluid ejected from a nozzle. The magnetohydrodynamic element does, in any case, function in this case as a drive element for the door leaf.

As in case of the aforementioned magnetorheological element or the damping element, a magnet is also provided for the magnetohydrodynamic element or drive element which will be acted upon accordingly by the control unit depending on the signal of the sensor and which consequently ensures the drive or non-drive or varies the strength of the resulting drive force. This depends again on the sensor signals, with the aid of which the control unit controls the magnet. As part of the invention the sensor monitors the different functional states of the door leaf and accordingly controls the magnetohydrodynamic element as a drive element for the door leaf.

In this context it is, for instance, feasible that a door leaf not adequately acted upon by an operator in closing direction is also acted upon by the magnetohydrodynamic drive in order to attain and assume its closed position in relation to the motor vehicle body. In this case, different functional states of the door leaf are checked again, such as its speed, acceleration, potential end stops or also the external temperature. The end stops are important for the drive in as far as the end stop ensures or has to ensure that the magnetohydrodynamic drive or the magnetohydrodynamic element is stopped accordingly for the opening movement of the door leaf.

In addition, there is generally the option of providing latch functioning states of a door latch assigned to a door leaf as an alternative or in addition to the functional states of the door leaf. As already described, this can be achieved by means of the damping element or drive element. In this way, generally latch functioning states such as a pre-ratchet position, an anti-theft position, a child lock position or similar safety positions can be realized or implemented on the door leaf with the aid of a damping element and/or the drive element. The damping element can, for instance, ensure that during a closing movement exerted by a user, the door leaf is moved into a pre-ratchet position and is then retained or braked with the aid of the damping element. In this pre-ratchet position, a closing drive typically ensures that the door leaf is moved into the main ratchet position.

Generally, a damping element can also be used to attain a child lock position. In this case, also a sensor is provided, detecting any activation of an internal door handle on, for instance, a rear motor vehicle side door. As soon as such an actuation is detected, the damping element dampened or braked in this case, ensures that the respective rear door cannot be opened, thus producing the child lock position. The damping element only releases the respective door leaf once an external door handle is operated. Similarly, the damping element can also be used to produce the anti-theft function.

In this context, the drive element can function as a door opening drive or can be used to initially push the door leaf out from the motor vehicle body during an opening process after which the further opening process is carried out manually by the operator or user. Generally, the drive element realized by means of the magnetohydrodynamic element can also assist the damping element when required, for instance, when the door leaf is to be actively moved into the pre-ratchet position. In this case, the magnetohydrodynamic element acts on the door leaf as a drive element, with the door leaf being decelerated again with the aid of the damping element upon reaching the pre-ratchet position.

All in all, the invention with the special magnetic device provides the option of acting on the door leaf with a virtually freely programmable damping and/or a freely programmable drive. As a result, any end stops for the door leaf can be selectively stipulated and changed. The end stops can, for instance, be adapted to the actual circumstances, leaving and entering the vehicle, etc. in for instance an (underground) car park. The magnetic device of the invention also offers the option of damping or driving the door leaf in order to regulate it. The damping or the driving of the door leaf can thus be user-specific. This means that, depending on the user and his/her handling of the door leaf, user-specific threshold values are set and stored in the control unit.

User A may, for instance, usually shut the door leaf at high speed, so that in this case the damping element only exerts a damping effect once a respectively high speed of the door leaf is exceeded. In contrast, user B tends to close the door leaf softly so that the aforementioned threshold value is not even reached. Nevertheless, attenuation is, however, often desired. The invention achieves this by the user-specific threshold value for, for instance, the closing speed of the door leaf, being stored in the control unit. For regulating, there is also the option of acting on the damping element in such a way that in all described examples, the door leaf engages in the respective latch at a speed regulated by the damping.—The object of the invention is also a method for acting on the door leaf in the described sense. The method is explained in detail in claims 8 to 10.

The invention thus provides a motor vehicle door including an associated method, allowing the option of generating and influencing nearly all practical functional states of the door leaf. Furthermore, also additional latch functions or latch function states of the door latch assigned to the door leaf can be realized. This is all achieved in a simple manner by a special magnetic element, essentially consisting of a magnet and a magnetorheological and/or magnetohydrodynamic element acted upon by the magnet. Both fundamental elements operate without making contact and are thus predestined for the described applications. The respective damping or driving force can solely be adjusted by means of the magnetic field generated by the magnet. Respective values are provided by the control unit reacting, in turn, to the signals of at least one or also several sensors.

Advantageously, the sensor is a rotary sensor or an angular position encoder. In the simplest form, this device detects the opening or closing angle completed or assumed by the door leaf in relation to the motor vehicle body. The speed and acceleration of the door leaf in relation to the motor vehicle body can also be detected in this manner and translated in the control unit into respective actuating movements for the magnetorheological or magnetohydrodynamic element.

Generally, the sensor can naturally alternatively or additionally simply be a switch with the aid of which, for instance, the damping element is fixed by the user in a desired position of the door leaf, thus fixing the door leaf. The invention also offers the option of influencing or stipulating the speed of the door leaf in the sense of a control unit regulation.

It is thus, for instance, feasible that the closing operation of the door leaf—irrespective of whether it is manual or motorized—adopts a determined and stipulated speed prior to reaching a closing position in relation to a motor vehicle body. During this operation, the position of the door leaf and its speed is determined by means of the rotary sensor or an angular position encoder. By acting on the damping element accordingly, the control unit now ensures that during the described closing operation, the speed of the door leaf remains within a specified range by comparing the actual and specified value of the respective speed. As a result, defined closing operations can be realized, which is particularly advantageous as regards the mechanical stressing of all parts and also as regards any potential unwanted acoustic noise. These are the main advantages of the invention.

Below, the invention is explained with reference to a drawing showing only one embodiment, in which:

DETAILED DESCRIPTION OF THE DRAWINGS

Figure 3:
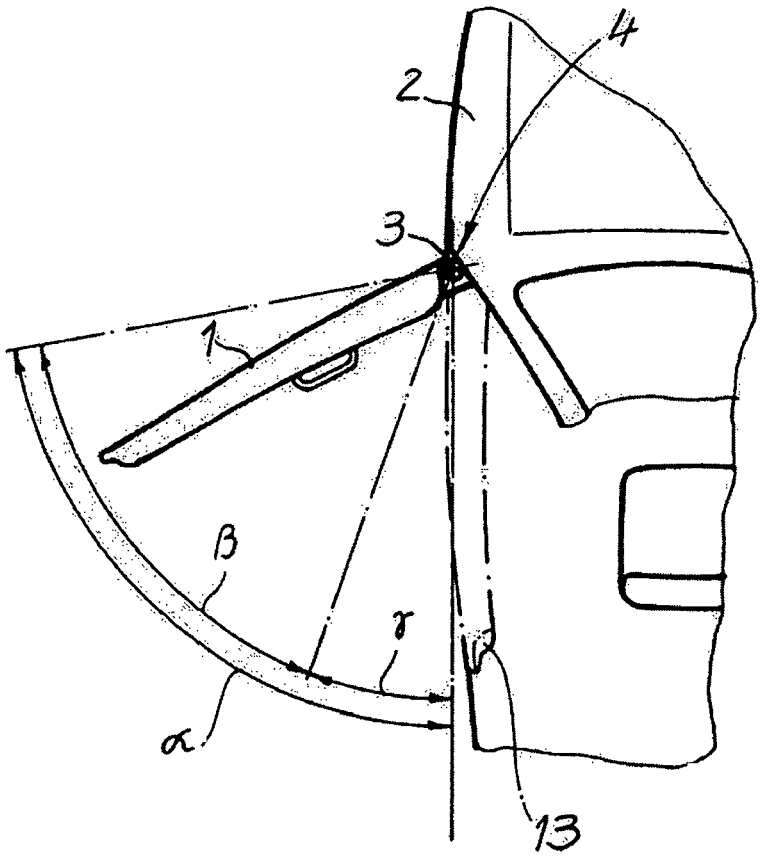
FIG. 3 shows the motor vehicle door of FIGS. 1 and 2 in different functional states.

The figures show a motor vehicle door containing a door leaf 1 that can be pivoted around a hinged axis 3 in relation to a motor vehicle body 2 in a manner shown in FIG. 3. During this operation, said leaf moves by a pivoting angle cc. The pivoting angle $\alpha$ indicates the maximum pivoting angle of the door leaf 1. For this purpose, the position of the door leaf 1 can contain an end stop on the opening end side, determined by magnetic device 4, described in more detail below.

In addition to said pivoting angle $\alpha$ or the associated pivoting range, FIG. 3 also shows a braking range with the respective braking angle $\beta$. The figure also shows a closing/opening range with the respective closing/opening angle $\gamma$. The closing/opening angle $\gamma$ can be an angle of up to approx. 20° in relation to the motor vehicle body 2. The brake angle $\beta$ following the closing/opening angle $\gamma$ can have a value of between 50° and 70°. The resulting total maximum pivoting angle $\alpha$ is thus approx. 90°, which is naturally only an example and does not limit the invention to this value.

Figure 1:
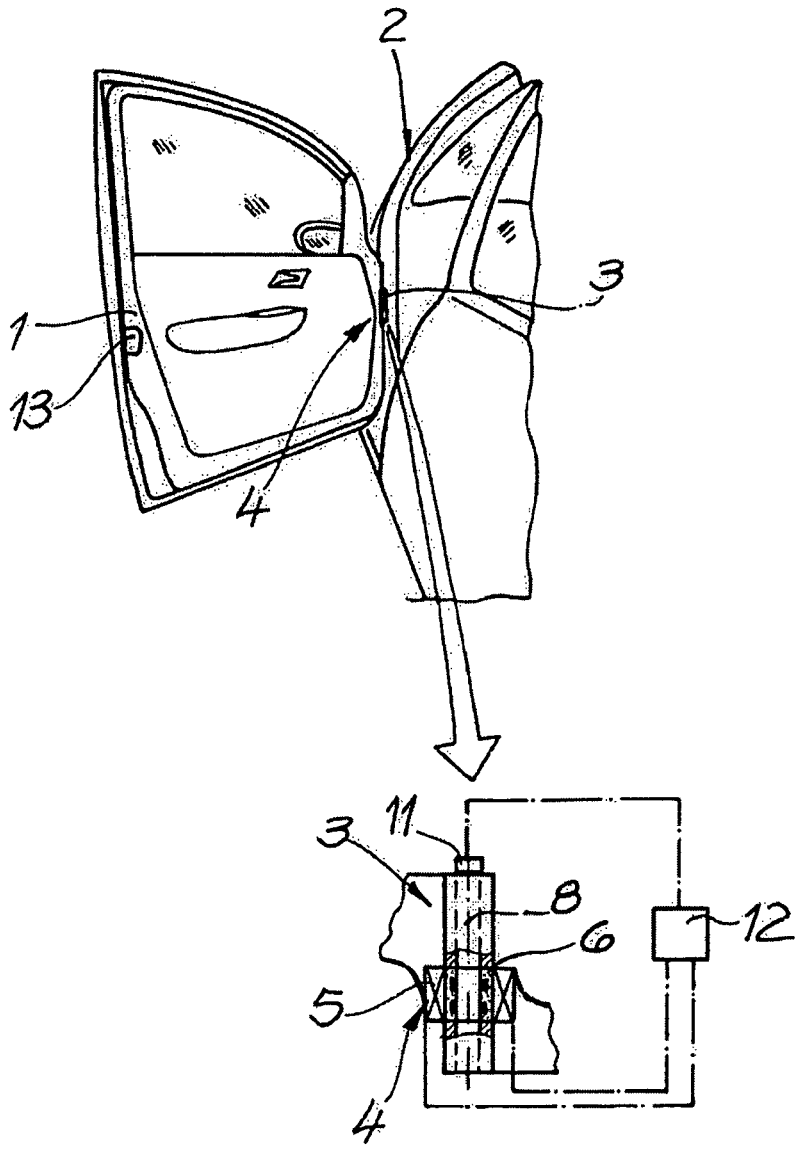
FIG. 1 shows a schematic section of the motor vehicle door of the invention
Figure 2:
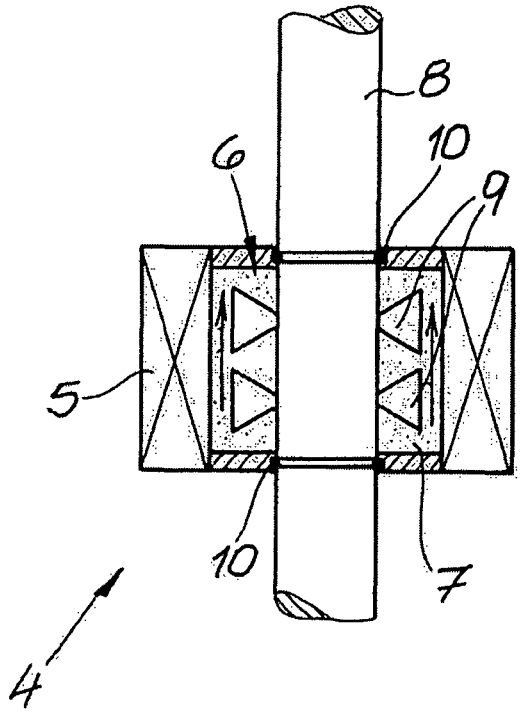
FIG. 2 shows the magnetic device in detail.

A comparison of FIGS. 1 and 2 shows that apart from the door leaf 1, the motor vehicle door contains the magnetic device 4. The magnetic device 4 is in this case a component of a drive—not shown in detail—or can assume the function of this drive. The magnetic device 4 is also able to carry out the function of a damping element for damping the movement of the door leaf 1. Lastly, the magnetic device 4 can also contain one or several end stops.

For this purpose, the magnetic device 4 first of all contains at least one magnet 5. According to FIG. 2, the magnet 5 is a torroid 5 around a chamber 6. This chamber 6 predominantly contains a magnetorheological fluid 7. Said chamber 6 can, however, also contain a magnetorheological elastomer instead of a magnetorheological fluid 7.

An axis 8 or a respective shaft 8 extends through the chamber 6. In the embodiment, the shaft 8 is mechanically connected to the door leaf 1 and carries out respective clockwise or counter-clockwise rotary movements in relation to the motor vehicle body 2 depending on the movement of the door leaf 1 in closing or opening direction. As a result, the paddles 9 connected to the shaft or axis 8 inside the chamber 6 rotate in clockwise or counter-clockwise direction in relation to the fixed chamber 6. Depending on the viscosity of the magnetorheological fluid 7 inside the chamber 6, the pivoting movement of the shaft 8 is dampened accordingly and can even be stopped completely in case of a large magnetic field generated by the magnet 5. The door leaf 1 is in this case fixed. An end stop can, for instance, correspond to this.

From FIG. 2 it is apparent that the (ring) magnet 5, surrounding chamber 6, like a ring or that the respectively designed coil or torroid 5 generates magnetic field lines essentially extending in axial direction in relation to the axis or shaft 8. This is indicated by respective arrows in FIG. 2. When a respective magnetic field is applied, the particles contained in the magnetorheological fluid 7 are aligned along these magnetic field lines. This increases the viscosity of the magnetorheological fluid 7 and it becomes more or less difficult to move the paddles 9. The shaft or axle 8 and at the same time the door leaf 1, is respectively dampened.

For this purpose, the entire magnetic device 4 shown in FIG. 2 can be integrated in a hinged axis or in the hinge 3 of the door leaf 1. As already explained, the shaft 8 follows the rotary movements of the door leaf 1 in relation to the motor vehicle body 2, taking into consideration pivot angle cc. In contrast, the magnet 5 and also the chamber 6 surrounded by the magnet 5 are fixed. In the embodiment, the shaft 8 extends through the chamber 6 filled with magnetorheological fluid 7 with the aid of respective ring seals or rotary unions 10.

In addition, the figure shows a sensor 11 and a control unit 12, schematically indicated in FIG. 1. The sensor 11 is, in this case, connected to shaft 8 and is designed as a rotary sensor or rotary encoder. In this way, the sensor 11 can transmit the position of the door leaf 1—for instance expressed by the pivoting angle $\alpha$—to the connected control unit 12. The control unit 12 can also deduce the speed of the door leaf 1 from the respective changes in position and the elapsed time. Depending on the determined speed of the door leaf 1 in relation to the motor vehicle body 2, the control unit 12 can then act on the magnetic device 4 or magnet 5 contained therein. This means that the control unit 12 controls the magnet 5 depending on the signals of the sensor 11 or on respective sensor signals.

In the embodiment, the magnetorheological element 7 is designed as a damping element providing adjustable damping. Alternatively or in addition to the magnetorheological element 7 also a magnetohydrodynamic element can be used at this point, which is, however, not shown in detail.

The magnetorheological element or the damping element 7 does indeed vary its damping depending on the functional states 10 of the door leaf 1 controlled by means of the sensor 11. Where the sensor 11 detects, for instance, a fast closing movement of the door leaf 1, the control unit 12 supplied with respective sensor signals by the sensor 11 ensures on the output side that the magnet 5 is, for instance, acted upon by a strong magnetic field. As a result, the magnetorheological fluid 7 or the respective magnetorheological element 7 has a high viscosity thus producing considerable damping with which the door leaf 1 is braked in the described scenario. Depending on the proximity of the door leaf 1 to the motor vehicle body 2 or depending on the braking angle β and proximity to the closing/opening angle γ, the damping can even be varied by the control unit 12 applying less energy to the magnet 5 in the example.

It is even feasible that the door leaf 1 has a regulated speed in relation to the motor vehicle body 2 within the braking angle β, so that the closing drive effective within the closing/opening angle γ in the embodiment can effectively grip and close the door leaf 1. No mechanical damage from a respectively designed closing aid does therefore have to be expected.—Instead of the speed of the door leaf 1, the sensor 11 can naturally also detect and evaluate other functional states of the door leaf 1. These include, for instance, acceleration of the door leaf 1, a direction of movement of the door leaf 1, etc. In this way, also variable end stops of the door leaf 1 can be provided.

When the door leaf 1 reaches, for instance, its maximum opening or pivoting angle α, the respective signal of the sensors 11 can be translated by the control unit 12 in such a way that the magnetic device 4 or the magnetorheological element or damping element 7 is acted upon in such a way that the door leaf 1 is respectively blocked as by means of an end stop.

It is also possible to determine the external temperature using another sensor—not shown. The signals of this temperature sensor are also processed in the control unit 12. The invention makes use of the fact that the viscosity of the magnetorheological fluid 7 and thus of the magnetorheological element 7 changes depending on the temperature. In general, the principle applies that the viscosity increases as the temperature reduces so that as a consequence, in case of for instance lower temperatures, generally less strong magnetic fields of the magnet 5 can be used, in order to provide comparative viscosities during the described damping process of the door leaf 1. According to the invention, the external temperature can, in any case, also be used for the described damping or driving process—not shown—with the aid of the magnetohydrodynamic element.

There is also the option of using the magnetic device 4 in order to take into consideration or provide alternative or additional latch function states of a door latch 13 assigned to the door leaf 1. The respective door latch 13 can actually assume, for instance, a functional position such as a pre-ratchet position, an anti-theft position or a child lock position. According to the invention, it is possible to produce, for instance, the pre-ratchet position by the door leaf 1 being stopped precisely in this pre-ratchet position with the aid of a magnetorheological element or damping element 7, which may correspond to a certain braking angle β. Beyond this braking angle β (in the area of the closing/opening angle γ) the door leaf 1 is, in the example, moved by a closing aid into the motor vehicle body or into its closed position. In a similar manner, the damping element 4 can be used to produce an anti-theft position or also a child lock position and other securing positions of the door leaf 1 or of the door latch 13.

The door latch 13 or the door leaf 1 in the main ratchet position can, for instance, also be retained with the aid of the damping element 4 or blocked in such a way that the door leaf 1 cannot be opened. In this way, a child lock function can, for instance, be provided without a child lock device. In this arrangement, actuation of the internal actuating lever is, for instance, not translated into the desired opening of the door leaf 1 as long as the damping element 4 blocks the door leaf 1. Only when a vehicle user releases the damping element 4 by actuating, for instance, a switch, thus switching off the "simulated" child lock, can the door leaf 1 also be opened from the inside.

The invention claimed is:

1. Motor vehicle door comprising a door leaf with a magnetic device and a hinge shaft that pivotally couples the door leaf to a motor vehicle, the magnetic device containing at least one magnet and a magnetorheological element, arranged around and acting on the hinge shaft, which is provided as a damping element allowing adjustable damping and can be actuated by the at least one magnet with the magnetorheological element, at least one sensor assigned to the door leaf for transmitting a door position via sensor signals, wherein the at least one sensor and the at least one magnet are connected to a control unit, said control unit actuating the magnet depending on the sensor signals, wherein the magnet varies a damping of the magnetorheological element depending on an acceleration of the door leaf as monitored by the at least one sensor, and wherein the control unit actuates the magnet and varies the damping depending on an external temperature monitored by the at least one sensor.

2. Motor vehicle door according to claim 1, where the control unit actuates the magnet and varies the damping depending on potential end stops of the door leaf.

3. Motor vehicle door according to claim 1, where the control unit actuates the magnet and varies the damping depending on latch functional states of the door latch associated to the door leaf selected from the group consisting of a pre-ratchet position, an anti-theft position, and a child lock position.

4. Motor vehicle door according to claim 1, wherein the magnetorheological element includes a chamber that contains a magnetorheological fluid or a magnetorheological elastomer and wherein the hinge shaft extends through the chamber, wherein the magnet is a ring that surrounds the chamber, wherein the shaft follows a rotary movement of the door leaf in relation to the motor vehicle body, wherein in contrast, the magnet and also the chamber surrounded by the magnet are fixed.

5. Motor vehicle door according to claim 4, further comprising paddles connected to the hinge shaft and positioned inside the chamber.

6. Motor vehicle door according to claim 5, wherein the at least one sensor assigned to the door leaf includes a rotary sensor or a rotary encoder connected to the hinge shaft.

7. Motor vehicle door according to claim 4, further comprising a plurality of paddles connected to the hinge shaft, wherein paddles are inside the chamber.

8. Motor vehicle door according to claim 4, wherein the hinge shaft extends both above and below the chamber.

9. Motor vehicle door according to claim 1, wherein the control unit actuates the magnet and varies the damping of the magnetorheological element depending on both the speed and an acceleration of the door leaf as monitored by the at least one sensor.

10. Motor vehicle door according to claim 1, wherein the at least one sensor assigned to the door leaf includes a rotary sensor or a rotary encoder connected to the hinge shaft.

11. Method for actuating a door leaf of a motor vehicle door, wherein actuating the door leaf includes one or more actions from the group consisting of braking, fixing, closing and opening the door leaf, in which the motor vehicle door contains the door leaf, a hinge shaft that pivotally couples the door leaf to the motor vehicle and a magnetic device containing at least one magnet and a magnetorheological element, arranged around the hinge shaft, which is provided as a damping element allowing adjustable damping and can be actuated by the at least one magnet, at least one sensor assigned to the door leaf for transmitting a door position via sensor signals, in which the at least one sensor determines individual functional states of the door leaf in relation to the motor vehicle body and transmits them to a control unit and in which the control unit energizes the magnetic device containing the magnetorheological element and actuatable by the magnet in such a way that the door leaf is either stopped, retained or closed, opened or pushed out, the method further comprising actuating the magnet thereby varying the damping of the magnetic device depending on an external temperature monitored by the at least one sensor.

12. Method according to claim 11, wherein alternative or additional latch functions of a door latch can be provided by means of the magnetorheological element.

13. Motor vehicle door comprising a door leaf with a magnetic device and a hinge shaft that pivotally couples the door leaf to a motor vehicle, the magnetic device containing at least one magnet and a magnetorheological element, arranged around and acting on the hinge shaft, which is provided as a damping element allowing adjustable damping and can be actuated by the at least one magnet with the magnetorheological element, at least one sensor assigned to the door leaf for transmitting a door position via sensor signals, wherein the at least one sensor and the at least one magnet are connected to a control unit, said control unit actuating the magnet depending on the sensor signals, wherein the magnet varies a damping of the magnetorheological element depending on a speed of the door leaf as monitored by the at least one sensor, and wherein the control unit actuates the magnet and varies the damping depending an external temperature monitored by the at least one sensor.

14. Motor vehicle door according to claim 13, wherein the control unit actuates the magnet and varies the damping depending on potential end stops of the door leaf.

15. Motor vehicle door according to claim 13, wherein the control unit actuates the magnet and varies the damping depending on latch functional states of a door latch associated to the door leaf selected from the group consisting of a pre-ratchet position, an anti-theft position, and a child lock position.

16. Motor vehicle door according to claim 13, wherein the magnetorheological element includes a chamber that contains a magnetorheological fluid or a magnetorheological elastomer and wherein the hinge shaft extends through the chamber, wherein the magnet surrounds the chamber.

17. Motor vehicle door according to claim 16, further comprising a plurality of paddles connected to the hinge shaft, wherein paddles are inside the chamber.

18. Motor vehicle door according to claim 16, wherein the hinge shaft extends both above and below the chamber.

19. Motor vehicle door according to claim 13, wherein the at least one sensor assigned to the door leaf includes a rotary sensor or a rotary encoder connected to the hinge shaft.

* * * * *